US011715916B2

(12) United States Patent
Qian

(10) Patent No.: US 11,715,916 B2
(45) Date of Patent: Aug. 1, 2023

(54) LEAKAGE PROTECTIVE SOCKET

(71) Applicant: YUYAO JIARONG ELECTRICAL APPLIANCE CO., LTD, Zhejiang (CN)

(72) Inventor: Jiacan Qian, Zhejiang (CN)

(73) Assignee: YUYAO JIARONG ELECTRICAL APPLIANCE CO., LTD, Zhejiang (CN)

( * ) Notice: Subject to any disclaimer, the term of this patent is extended or adjusted under 35 U.S.C. 154(b) by 13 days.

(21) Appl. No.: 17/488,321

(22) Filed: Sep. 29, 2021

(65) Prior Publication Data

US 2022/0102921 A1 Mar. 31, 2022

(30) Foreign Application Priority Data

Sep. 30, 2020 (CN) ..... 202011064376.0
Sep. 10, 2021 (CN) ..... 202122191427.2

(51) Int. Cl.
*H01R 13/713* (2006.01)

(52) U.S. Cl.
CPC ..... *H01R 13/713* (2013.01)

(58) Field of Classification Search
CPC ..... H01R 13/713; H01R 24/76
See application file for complete search history.

(56) References Cited

U.S. PATENT DOCUMENTS 6,829,124 B2 * 12/2004 Leopold ..... H01H 83/02 361/42
11,387,065 B2 * 7/2022 Qian ..... H02H 3/04
2018/0115146 A1 * 4/2018 Murahari ..... H05K 1/18
2019/0058299 A1 * 2/2019 Bryan ..... H01R 13/506

FOREIGN PATENT DOCUMENTS

CA 2512785 A1 * 9/2006 ..... H01H 83/04
CN 104917000 A * 9/2015
CN 213340970 U 6/2021

OTHER PUBLICATIONS

First office action of the second priority CN2021221914272 dated Jan. 10, 2022.

* cited by examiner

*Primary Examiner* — Travis S Chambers
(74) *Attorney, Agent, or Firm* — Gang Yu

(57) ABSTRACT

The disclosure discloses a leakage protective socket, relating to the technical field of electrical equipment protection. The leakage protective socket includes: a socket housing, and a leakage protector and an electrical connection portion arranged in the socket housing. The socket housing includes a support frame for fixing the electrical connection portion, a base for fixing the leakage protector, and a power socket for connecting an external power supply. One end of the electrical connection portion is provided with a wiring end, and the other end of the electrical connection portion is provided with at least one plug-in end. The leakage protector controls the opening and closing of a circuit between the power socket and the wiring end.

18 Claims, 15 Drawing Sheets

LEAKAGE PROTECTIVE SOCKET

CROSS-REFERENCE TO RELATED APPLICATIONS

The present disclosure claims priority to Chinese Patent Application No. 2020110643760, filed on Sep. 30, 2020 and entitled "Leakage Protective Socket", and Chinese Patent Application No. 20211221914272, filed on Sep. 10, 2021 and entitled "Leakage Protective Socket", the contents of which are hereby incorporated by reference in its entirety.

TECHNICAL FIELD

The disclosure relates to a technical field of electrical equipment protection, in particular to a leakage protective socket.

BACKGROUND

Receptacles are widely used in daily life, but there are many abnormal conditions easy to occur, and electrical leakage often occurs in the receptacles. A main function of a leakage protector is to disconnect a main line in time in case of an electrical leakage fault of a device or a need to protect human from fatal electric shock, so the leakage protector is widely used.

SUMMARY

In a first aspect, the technical problems to be solved are described.

For the problem, a leakage protective socket is provided in the disclosure. In the leakage protective socket, a leakage protector structure is combined with a receptacle structure, at the same time, a coil continuous power-supply suction release mechanism is used. In case of power interruption, poor contact and lack of phase, a pull-in holding circuit of the leakage protective socket cannot generate a magnetic force to attract a self-releasing mechanism due to loss of voltage, which results in an opening of a release circuit and a breaking of a closing contact to form active protection and eliminate potential safety hazard.

For the above defects existing in the conventional art, the disclosure especially provides a leakage protective socket, which solves a safety problem existing in the existing receptacle, and also solves a leakage protective problem when multiple receptacles are connected.

In a second aspect, technical solutions are provided.

To solve the above technical problems, the disclosure provides a leakage protective socket, which includes: a socket housing, and a leakage protector and an electrical connection portion disposed in the socket housing.

The socket housing includes a support frame for fixing the electrical connection portion, a base for fixing the leakage protector, and a power socket for connecting an external power supply.

One end of the electrical connection portion is provided with a wiring end, and the other end of the electrical connection portion is provided with at least one plug-in end. An upper portion of the socket housing is provided with a receptacle hole corresponding to the plug-in end. The leakage protector is configured to control an opening and closing of a circuit between the power socket and the wiring end.

The leakage protector includes: a protector device and an elastic sheet. Wherein the protector device is disposed on an upper portion of the base, and used to control an opening and closing of the elastic sheet and the wiring end.

The protector device includes a connection maintaining device, a connecting device and a locking device. The locking device is disposed between the connection maintaining device and the connecting device.

The locking device includes an elastic sheet pressing block, a locking lever, a first pin shaft and a second pin shaft. The locking lever is movably hinged with a second support, which is disposed on the connecting device, through the second pin shaft. The elastic sheet pressing block is movably hinged with a first support, which is disposed in a middle position of the base, through the first pin shaft. The locking lever is provided with a latch, a movable pressing plate and a buckle slide.

The elastic sheet pressing block includes an upper pressing block, a lower pressing block and a pressing block spring. The upper pressing block is provided with a buckle and a vertical fork groove. The lower pressing block is provided with a pressing rod. The upper pressing block is hinged with the lower pressing block through the first pin shaft. The pressing block spring in a compressed state is disposed between the upper pressing block and the lower pressing block. When the pressing rod is abutted against the elastic sheet, an elastic force of the pressing block spring makes the pressing rod maintain a stable force on the elastic sheet. The buckle is used for abutting against the latch.

The connecting device is provided with the second iron core extending in a transverse direction which is in clamped coordination with the vertical fork groove. The connection maintaining device includes a first iron core disposed longitudinally, the first iron core is used for magnetic adsorption coordination with the movable pressing plate.

When the connection maintaining device is powered on, the second iron core drives, through the vertical fork groove, the elastic sheet pressing block to rotate, the pressing rod located at a bottom of the elastic sheet pressing block is able to press down the elastic sheet, at the same time, the buckle slides upward along the buckle slide, and in a process that the buckle slides to abut against the latch, the movable pressing plate continues moving downward and is fixed through absorption of the first iron core. The connection maintaining device is used for fixing a position of the locking lever, so that the elastic sheet pressing block maintains a pressed-down state, and the elastic sheet and the wiring end maintain an on state, and then circuit connecting is realized.

When the connection maintaining device is powered off, the connection maintaining device stops working, the locking lever is released, and the latch is out of the buckle, so that the elastic sheet is disconnected from the wiring end, and then circuit opening is realized.

The leakage protector includes: the protector device and the elastic sheet. The protector device is disposed on an upper the base, and controls an opening and closing of the elastic sheet and the wiring end.

The protector device includes a connection maintaining device, a connecting device and the locking device. The locking device is disposed between the connection maintaining device and the connecting device.

The locking device includes an elastic sheet pressing block, a locking lever, a first pin shaft and a second pin shaft. The locking lever is movably hinged with a second support, which is arranged on the connecting device, through the second pin shaft. The elastic sheet pressing block is movably hinged with the first support, which is disposed in a middle position of the base, through the first pin shaft. The locking lever is provided with a latch, a movable pressing plate and a buckle slide.

The elastic sheet pressing block is provided with the buckle, a vertical fork groove and a pressing rod. The buckle is used for abutting against the latch.

The connecting device is provided with a second iron core extending in a transverse direction which is in clamped coordination with the vertical fork groove. The connection maintaining device includes a first iron core disposed longitudinally which is used for magnetic adsorption coordination with the movable pressing plate.

When the connection maintaining device is powered on, the second iron core drives, through the vertical fork groove, the elastic sheet pressing block to rotate, the pressing rod located at a bottom of the elastic sheet pressing block presses down the elastic sheet, at the same time, the buckle slides upward along the buckle slide, and in a process that the buckle slides to abut against the latch, the movable pressing plate continues moving downward and is fixed through absorption of the first iron core. The connection maintaining device is used for fixing a position of the locking lever, so that the elastic sheet pressing block maintains a pressed-down state, and the elastic sheet and the wiring end maintain an on state, and then circuit connecting is realized.

When the connection maintaining device is powered off, the connection maintaining device stops working, the locking lever is released, and the latch is out of the buckle, the elastic sheet is disconnected from the wiring end, and then circuit opening is realized.

The leakage protective socket include a hinging base disposed on a hinging position between the upper pressing block and the lower pressing block, wherein the first pin shaft is disposed in the hinging base in a penetration manner; and a limiting block, disposed on the hinging base, wherein the limiting block is used for controlling an opening angle between the upper pressing block and the lower pressing block when rotating with the first pin shaft as an axis.

The locking lever is provided with a pressing plate pin hole, and the movable pressing plate is hinged with the pressing plate pin hole through a pin shaft.

The elastic sheet includes a first elastic sheet and a second elastic sheet. The first elastic sheet and the second elastic sheet are fixed through elastic sheet clamping slots disposed at two sides of the connection maintaining device.

The wiring end is provided with an electrical contact. Ends of the first elastic sheet and the second elastic sheet are provided with an elastic sheet contact corresponding to the electrical contact. When the pressuring rod presses down the elastic sheet, the elastic sheet contact is abutted against a corresponding electrical contact.

The socket housing is also provided with a reset button and a test button, and bottoms of the reset button and the test button are respectively provided with a corresponding micro switch.

The socket housing also includes an extension wire base, and the extension wire base is used for electrical connection with another receptacle or electric device.

The extension wire base is provided with an extension wiring end which is extending, and the leakage protector is configured to control an opening and closing of the circuit between the power socket and the extension wiring end.

The extension wiring end is provided with an extension wiring contact. The extension wiring contact is disposed in parallel with the electrical contact. When the pressing rod presses down the elastic sheet, the elastic sheet contact is abutted against both the electrical contact and the extension wiring contact.

The socket housing is provided with a first indication observing portion. The pressing plate pin hole is provided with an indication block. A position of the first indication observing portion corresponds to a position of the indication block. When the connection maintaining device is powered on, the indication block is observed through the first indication observing portion.

The socket housing is provided with a second indication observing portion. The protector device is provided with an indicator lamp. When the connection maintaining device is powered on, it is observed through the second indication observing portion that the indicator lamp lights up.

The leakage protector includes a mutual inductor. The mutual inductor includes a mutual inductor shell, a mutual inductance coil disposed inside the mutual inductor shell, and a hard electrical connecting wire disposed on the mutual inductor shell in a penetration manner and passes through the mutual inductance coil. One end of the hard electrical connecting wire is connected with the power socket, and the other end of the hard electrical connecting wire is connected with the elastic sheet.

The hard electrical connecting wire is a metal sheet in a bending state.

The connection maintaining device includes a maintaining coil. The maintaining coil is fixed in a cavity of the connection maintaining device. The first iron core is vertically fixed in an inner cavity of the maintaining coil. One end of the first iron core is fixedly connected with a bottom of the connection maintaining device, and the other end of the first iron core is used for absorbing the movable pressing plate.

The connecting device also includes a connecting coil and a connecting spring. The connecting coil is fixed in a cavity of the connecting device, and the connecting spring and the second iron core are horizontally disposed in an inner cavity of the connecting coil.

In a third aspect, beneficial effects are described.

Compared with the conventional art, the leakage protective socket provided by the disclosure effectively solves a safety problem in the existing receptacle by setting a structure of leakage protector inside the receptacle.

Meanwhile, by connecting the upper pressing block with the lower pressing block through the pressing block spring to form the elastic sheet pressing block, the elastic sheet pressing block no longer presses tight the elastic sheet relying only on a fixing and limiting mechanical structure. By using the pressing block spring, the pressing rod at the lower pressing block can apply a stable pressing force on the elastic sheet, thereby ensuring pressing force of the pressing rod at the lower pressing block on the elastic sheet, and then making an electric connection in the leakage protective socket stable and reliable.

A stable and effective state display of the leakage protective socket is ensured by setting an indicating device of the mechanical structure and electrical structure.

Further, the scope of application of the leakage protective socket in the disclosure is greatly expanded by setting the extension wiring end.

Figure 1:
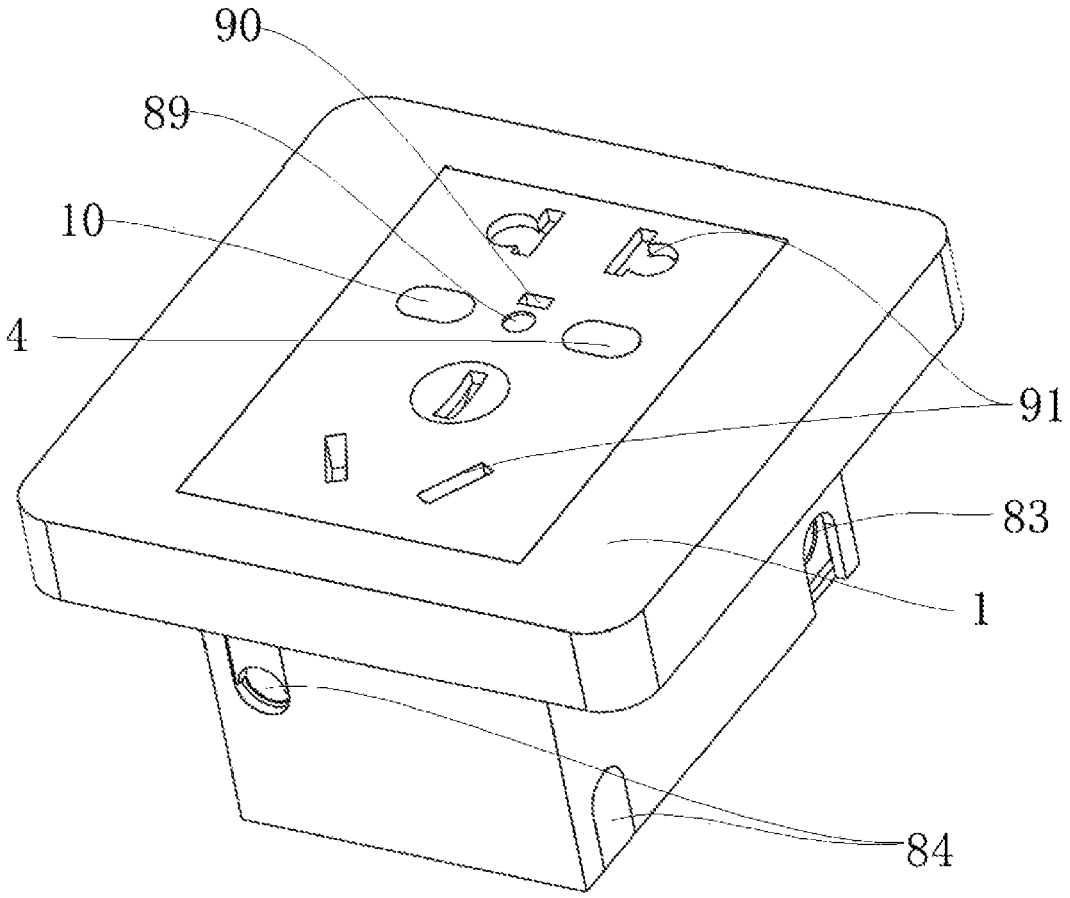
FIG. 1 is a three-dimensional diagram of a leakage protective socket according to the first embodiment of the disclosure.

In the drawings, 1, a socket housing; 2, a protector device; 3, an electrical connection portion; 4 is a reset button; 5, an elastic sheet; 6, a connection maintaining device; 7, a connecting device; 8, a locking device; 8*a*, an elastic sheet pressing block; 8*b*, a locking lever; 8*c*, an upper pressing block; 8*d*, a lower pressing block; 9, a pressing block spring; 10, a test button; 11, an extending sheet; 12, a limiting block; 13, a lug boss; 14, a clamping groove; 16, an electrical contact; 21, a first pin shaft; 22, a pressing rod; 23, a vertical fork groove; 24, a buckle; 31, a second pin shaft; 33, a latch; 34, a movable pressing plate; 36, a buckle slide; 42, an indication block; 43, a first support; 51, an elastic sheet contact; 52, a first elastic sheet; 53, a second elastic sheet; 61, a maintaining coil; 62, a first iron core; 63, a pressing plate pin hole; 64, a second support; 71, a connecting coil; 72, a second iron core; 73, a connecting spring; 81, a support frame; 82, a base; 83, a power socket; 84, an extension wire base; 85, a wiring end; 86, a plug-in end; 87, an extension wiring end; 88, a micro switch; 89, a first indication observing portion; 90, a second indication observing portion; 91, a receptacle hole; 92, a wiring contact; 94, a hard electrical connecting wire; 101, a fixed iron core; 102, a movable iron core; 103, a horizontal fork groove; and 104, a box-shaped fixing frame.

DETAILED DESCRIPTION OF THE EMBODIMENTS

The specific implementation modes of the disclosure are described in detail below in combination with the accompanying drawings and embodiments. The following embodiments are used for illustrating the disclosure, but not for limiting the scope of the disclosure.

First Embodiment

As shown in FIG. 1 to FIG. 5, the first embodiment of the present disclosure provides a leakage protective socket, the leakage protective socket include: a socket housing 1, and a leakage protector and an electrical connection portion 3 disposed in the socket housing 1.

The socket housing 1 includes a support frame 81 for fixing the electrical connection portion 3, a base 82 for fixing the leakage protector, and a power socket 83 for connecting an external power supply.

One end of the electrical connection portion 3 is provided with a wiring end 85, and the other end of the electrical connection portion 3 is provided with at least one plug-in end 86. In the embodiment, the electrical connection portion 3 is a conductive metal sheet with a bending structure, and is fixedly clamped through the support frame 81. The support frame 81 is disposed on an upper a circuit board. The plug-in end 86 is used for plug-in coordination with pins of various electrical appliances, so the plug-in end 86 has a structure design of clamping function. In the present embodiment, the plug-in end 86 includes a three-pin socket and a two-pin socket, the upper portion of the socket housing 1 is provided with a receptacle hole 91 corresponding to the plug-in end 86. The leakage protector is configured to control an opening and closing of a circuit between the power socket 83 and the wiring end 85.

Figure 6:
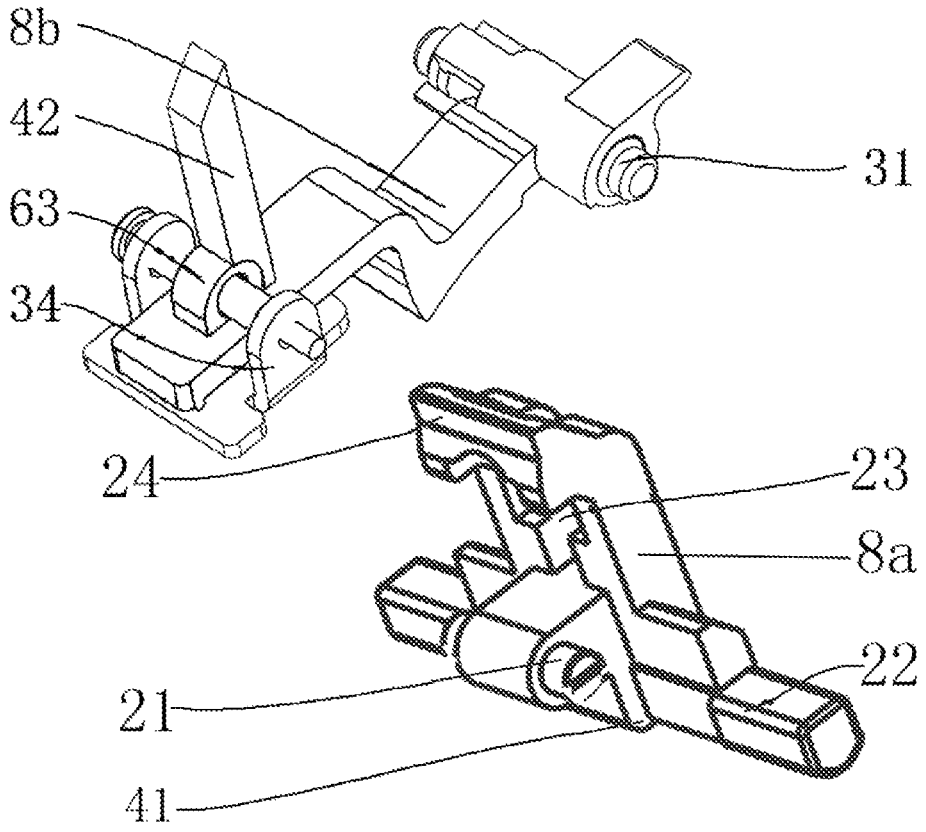
FIG. 6 is a first structure diagram of a locking device of a leakage protective socket according to the first embodiment of the disclosure.
Figure 7:
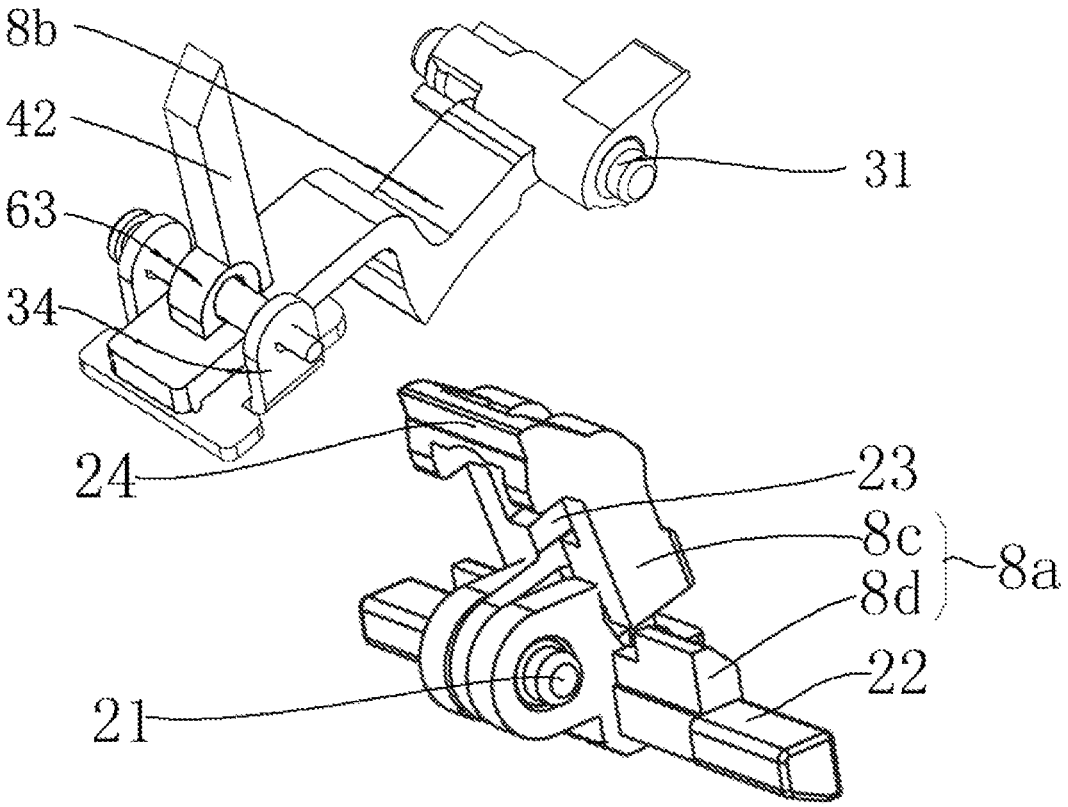
FIG. 7 is a second structure diagram of a locking device of a leakage protective socket according to the second embodiment of the disclosure.
Figure 8:
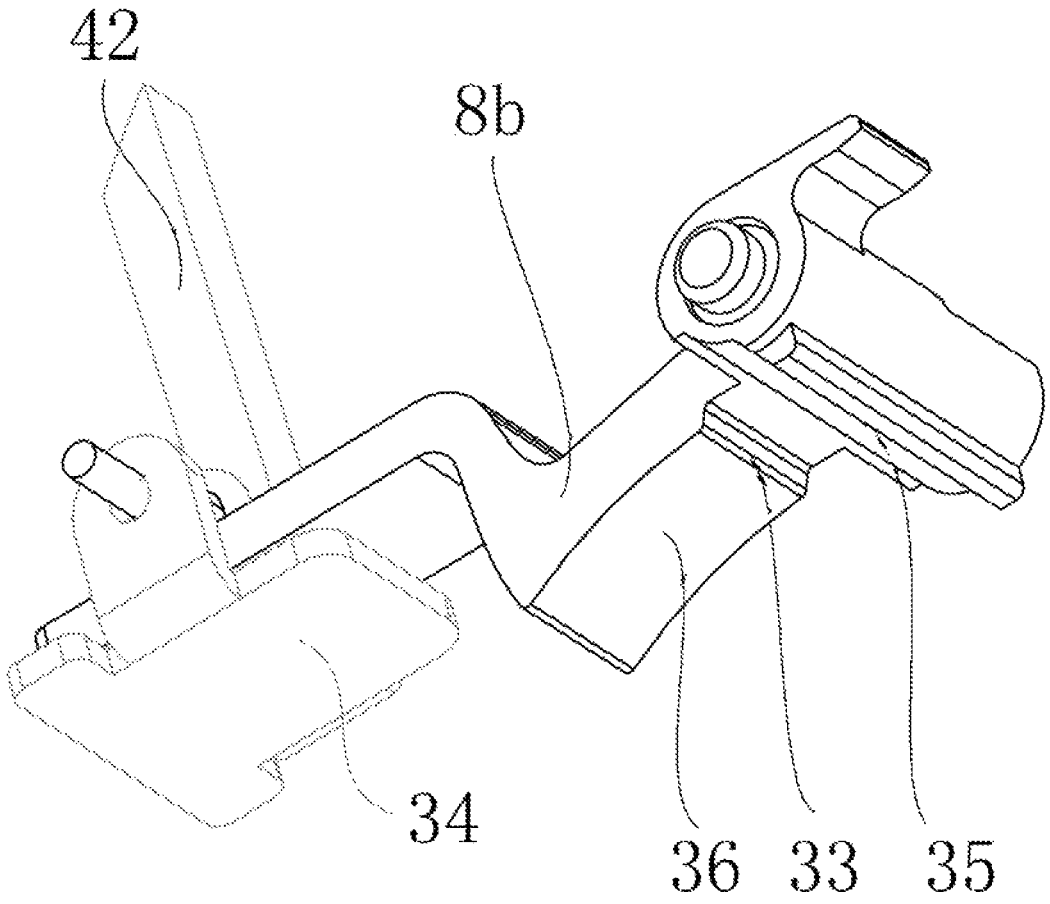
FIG. 8 is a structure diagram of a locking lever of a leakage protective socket according to the second embodiment of the disclosure.
Figure 9:
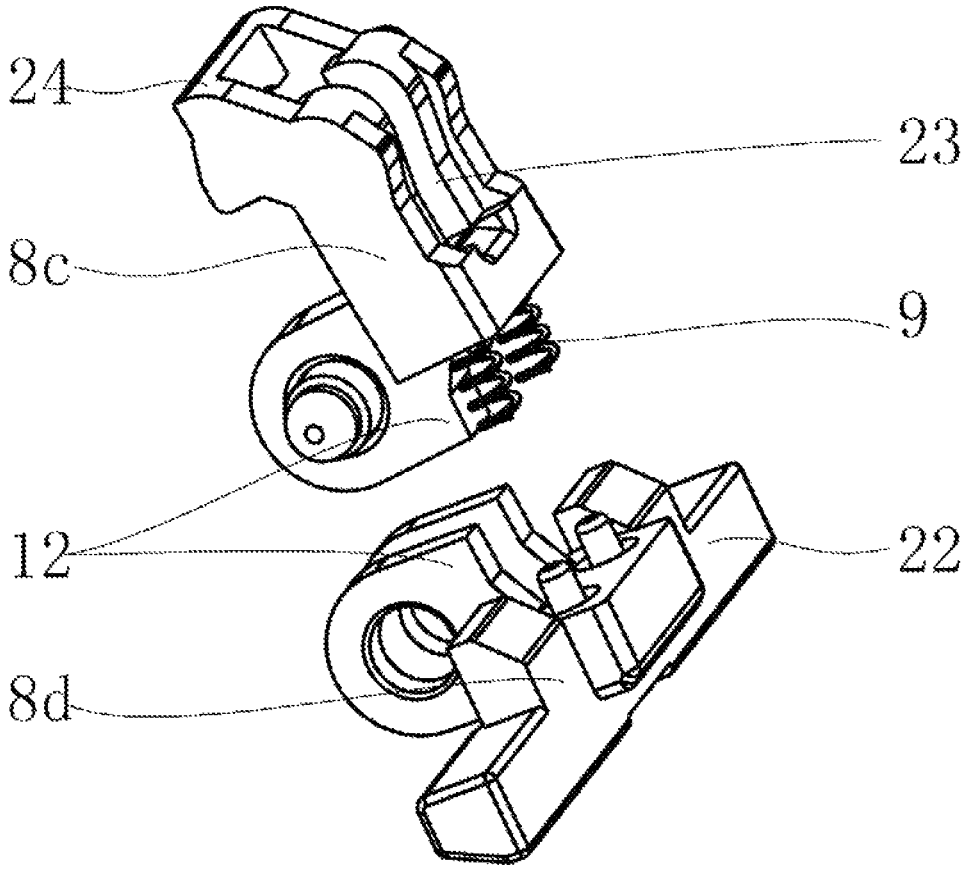
FIG. 9 is a first structure diagram of an elastic sheet pressing block of a leakage protective socket according to the second embodiment of the disclosure.
Figure 10:
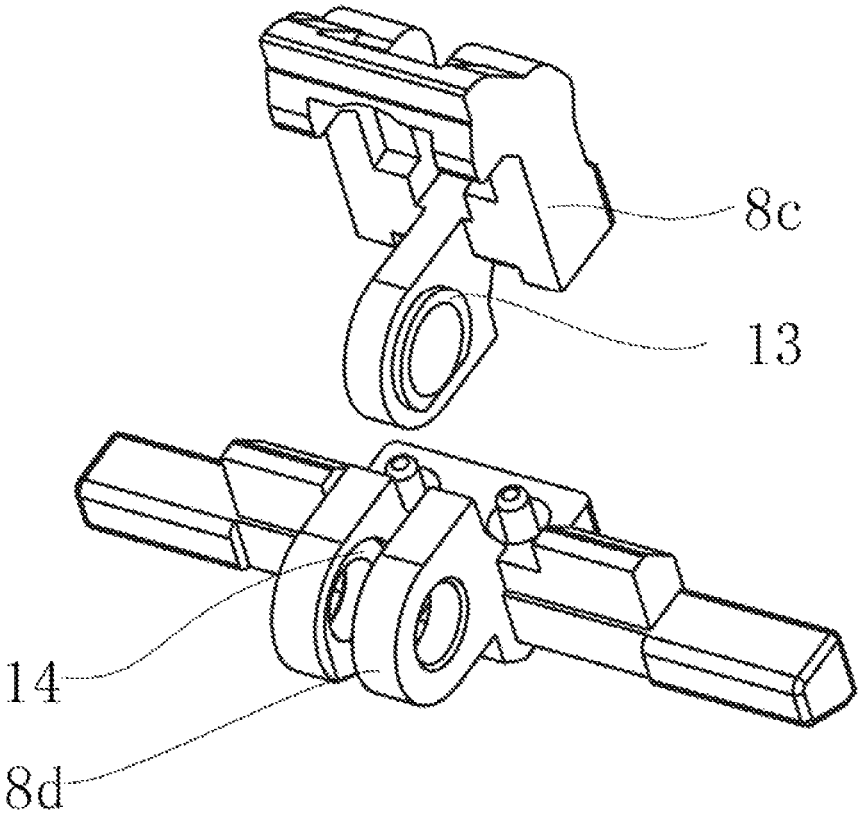
FIG. 10 is a second structure diagram of an elastic sheet pressing block of a leakage protective socket according to the second embodiment of the disclosure.

As shown in FIG. 6, the leakage protector includes: a protector device 2 and an elastic sheet 5. The protector device 2 is disposed on an upper portion of the base 82, and used to control an opening and closing of the elastic sheet 5 and the wiring end 85.

The protector device 2 includes a connection maintaining device 6, a connecting device 7 and a locking device 8. The locking device 8 is disposed between the connection maintaining device 6 and the connecting device 7.

The locking device 8 includes an elastic sheet pressing block 8*a*, a locking lever 8*b*, a first pin shaft 21 and a second pin shaft 31. The locking lever 8*b* is movably hinged with a second support 64, which is disposed on the connecting device 7, through the second pin shaft 31. The elastic sheet pressing block 8*a* is movably hinged with a first support 43, which is disposed in the middle of the base 82, through the first pin shaft 21. The locking lever 8*b* is provided with a latch 33, a movable pressing plate 34 and a buckle slide 36. The elastic sheet pressing block 8*a* is provided with a buckle 24, a vertical fork groove 23 and a pressing rod 22. The buckle 24 is used for abutting against the latch 33. According to different needs of customers, the positions of the first support 43 and the second support 64 is adjusted.

The connecting device 7 is provided with a second iron core 72 extending in a transverse direction which is in clamped coordination with the vertical fork groove 23. The connection maintaining device 6 includes the first iron core 62 disposed longitudinally, the first iron core is used for magnetic adsorption coordination with the movable pressing plate 34.

When the buckle 24 slides counterclockwise along the buckle slide 36, the locking lever 8*b* continues rotating clockwise to avoid a situation that the movable pressing plate 34 pauses or jumps when the buckle 24 slides counterclockwise along the buckle slide 36. Pause or jump will affect the speed of the movable pressing plate 34 absorbing to fix the first iron core 62, and a too low speed will cause the failure of closing of the leakage protector.

When the connection maintaining device 6 is powered on, the second iron core 72 drives, through the vertical fork groove 23, the elastic sheet pressing block 8*a* to rotate, so that the pressing rod 22 located at a bottom of the elastic sheet pressing block 8*a* is able to press down the elastic sheet 5, at the same time, the buckle 24 slides upward along the buckle slide 36, and in a process that the buckle 24 slides to abut against the latch 33, the movable pressing plate 34 continues moving downward and is fixed through absorption of the first iron core 62. The connection maintaining device 6 is used for fixing a position of the locking lever 8*b*, so that the elastic sheet pressing block 8*a* maintains a pressed-down state, and the elastic sheet 5 and the wiring end 85 maintain an on state, and then circuit connecting is realized.

When the connection maintaining device 6 is powered off, the connection maintaining device 6 stops working, the locking lever 8*b* is released, and the latch 33 is out of the buckle 24, so that the elastic sheet 5 is disconnected from the wiring end 85, and then circuit opening is realized. The locking lever 8*b* is provided with a pressing plate pin hole 63, and the movable pressing plate 34 is hinged with the pressing plate pin hole 63 through a pin shaft.

The elastic sheet 5 includes a first elastic sheet 52 and a second elastic sheet 53. The first elastic sheet 52 and the second elastic sheet 53 are fixed through elastic sheet clamping slots arranged at two sides of the connection maintaining device 6. The wiring end 85 is provided with an electrical contact 16. Ends of the first elastic sheet 52 and the second elastic sheet 53 are provided with an elastic sheet contact 51 corresponding to the electrical contact 16. When the pressuring rod 22 presses down the elastic sheet 5, the elastic sheet contact 51 is abutted against the electrical contact 16.

As shown in FIG. 1, the socket housing 1 is also provided with a reset button 4 and a test button 10, and bottoms of the reset button 4 and the test button 10 are respectively provided with a corresponding micro switch 88.

The socket housing 1 is provided with a first indication observing portion 89. The pressing plate pin hole 63 is provided with an indication block 42. A position of the first indication observing portion 89 corresponds to a position of the indication block 42. When the connection maintaining device 6 is powered on, the indication block 42 is observed through the first indication observing portion 89. By setting the first indication observing portion 89 and the indication block 42, users more intuitively sees the state of the leakage protective socket in the present embodiment, and the indicating device with the mechanical structure is more stable and reliable.

Figure 11:
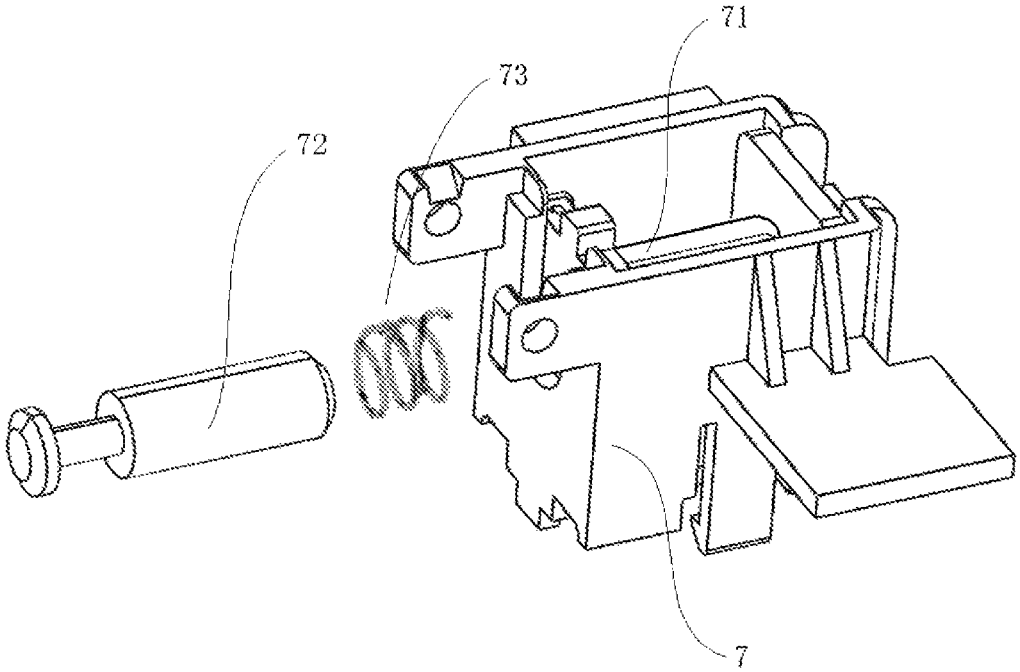
FIG. 11 is a structure diagram of a connecting device of a leakage protective socket according to the first embodiment of the disclosure.

As shown in FIG. 11, the connecting device 7 also includes a connecting coil 71 and a connecting spring 73. The connecting coil 71 is fixed in a cavity of the connecting device 7, and the connecting spring 73 and the second iron core 72 are horizontally disposed in the inner cavity of the connecting coil 71 in order. When the power supply is off, an elastic force of the elastic sheet 5 makes the elastic sheet pressing block 8*a* rotate clockwise, which causes the pressing rod 22 to lift and release the elastic slice 5. When the connecting coil 71 is powered on, the second iron core 72 drives the elastic sheet pressing block 8*a* to rotate counterclockwise by clamping with the vertical fork groove 23.

Figure 12:
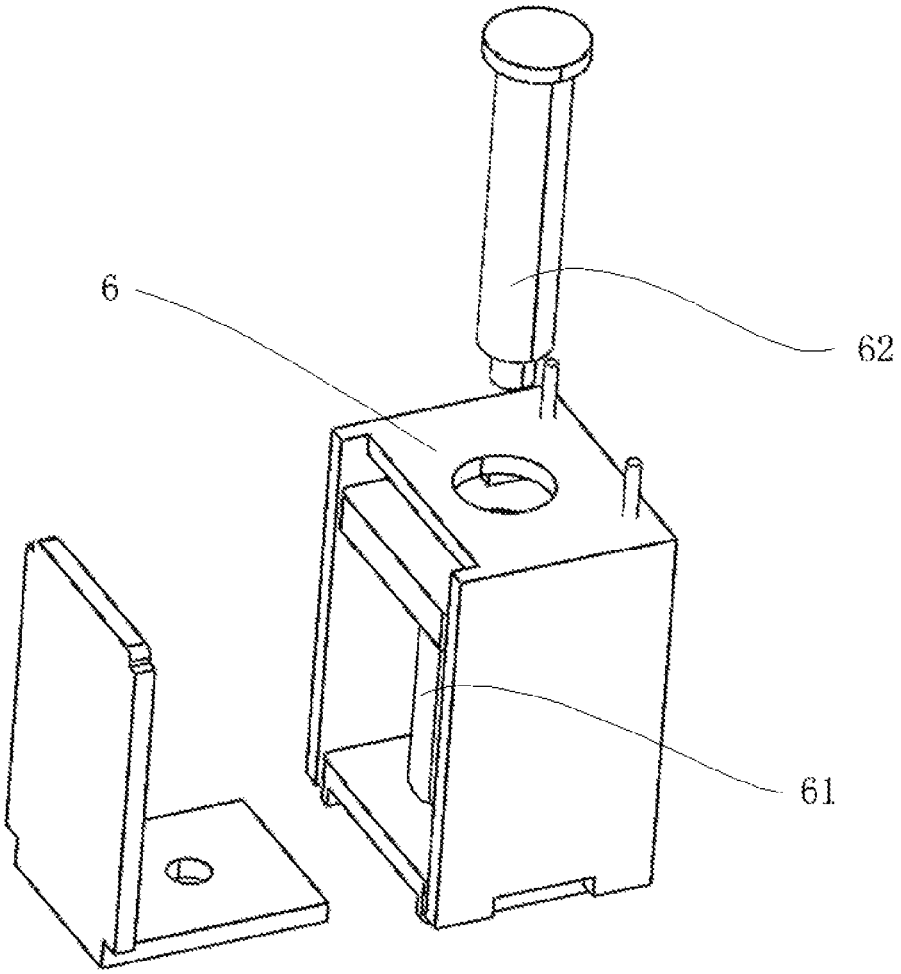
FIG. 12 is a structure diagram of a connection maintaining device of a leakage protective socket according to the first embodiment of the disclosure.

As shown in FIG. 12, the connection maintaining device 6 also includes a maintaining coil 61. The maintaining coil 61 is fixed in a cavity of the connection maintaining device 6. The first iron core 62 is vertically arranged in the inner cavity of the maintaining coil 61. One end of the first iron core 62 is fixedly connected with a bottom of the connection maintaining device 6, and the other end of the first iron core 62 is used for absorbing the movable pressing plate 34. When the connection maintaining device 6 is powered on, the maintaining coil 61 is powered on, so that the movable pressing plate 34 is absorbed by the first iron core 62, and then the buckle 24 and the latch 33 maintain an abutted state, and the leakage protector is in a connected state. When the connection maintaining device 6 is powered off, the maintaining coil 61 is powered off, and the movable pressing plate 34 is released, so that the latch 33 is out of the buckle 24, and the elastic sheet 5 is disconnected from a pin 3, and then receptacle opening is realized. An L-shaped metal plate is provided in the connection maintaining device 6. One end of the first iron core 62 is fixed at a bottom of the metal plate. When the movable pressing plate 34 is absorbed by the connection maintaining device 6, the movable pressing plate 34 abuts against both the first iron core 62 and the side plate of the L-shaped metal plate to ensure that the connection maintaining device 6 absorbs to fix the movable pressing plate 34 stably.

Second Embodiment

Compared with the first embodiment, in the present embodiment, as shown in FIG. 7 to FIG. 10, the elastic sheet pressing block 8*a* includes an upper pressing block 8*c*, a lower pressing block 8*d* and a pressing block spring. The upper pressing block 8*c* is provided with the buckle 24 and the vertical fork groove 23. The lower pressing block 8*d* is provided with the pressing rod 22. The upper pressing block 8*c* is hinged with the lower pressing block 8*d* through the first pin shaft 21. The pressing block spring 9 in a compressed state is arranged between the upper pressing block 8*c* and the lower pressing block 8*d*. When the pressing rod 22 is abutted against the elastic sheet 5, an elastic force of the pressing block spring 9 makes the pressing rod 22 maintain a stable force on the elastic sheet 5. The buckle 24 is used for abutting against the latch 33. According to the different needs of customers, the positions of the first support 43 and the second support 64 are adjusted.

The connecting device 7 is provided with a second iron core 72 extending in a transverse direction which is in clamped coordination with the vertical fork groove 23. The connection maintaining device 6 includes the first iron core 62 arranged longitudinally which is used for magnetic adsorption coordination with the movable pressing plate 34.

When the connection maintaining device 6 is powered on, the second iron core 72 drives, through the vertical fork groove 23, the elastic sheet pressing block 8*a* to rotate, so that the pressing rod 22 located at the bottom of the elastic sheet pressing block 8*a* presses down the elastic sheet 5, at the same time, the buckle 24 slides upward along the buckle slide 36, and in the process that the buckle 24 slides to abut against the latch 33, the movable pressing plate 34 continues moving downward and is fixed through absorption of the first iron core 62. The connection maintaining device 6 is used for fixing a position of the locking lever 8*b*, so that the elastic sheet pressing block 8*a* maintains a pressed-down state, and the elastic sheet 5 and the wiring end 85 maintain an on state, and then circuit connecting is realized.

When the connection maintaining device 6 is powered off, the connection maintaining device 6 stops working, the locking lever 8*b* is released, and the latch 33 is out of the buckle 24, so that the elastic sheet 5 is disconnected from the wiring end 85, and then circuit opening is realized.

The leakage protective socket includes a hinging base disposed on a hinging position between the upper pressing block 8*c* and the lower pressing block 8*d*, the first pin shaft 21 is disposed in the hinging base in a penetration manner, a limiting block 12, disposed on the hinging base, wherein the limiting block is used for controlling an opening angle between the upper pressing block 8*c* and the lower pressing block 8*d* when rotating with the first pin shaft 21 as an axis, that is, making an angle of the upper pressing block 8*c* and the lower pressing block 8*d* rotating about the first pin shaft 21 within a certain range. At the same time, such a design can ensure that the elastic sheet pressing block 8*a* will not automatically disassemble after assembly due to the pressing block spring 9, that is, the upper pressing block 8*c* and the lower pressing block 8*d* can be limited.

The hinging base is provided with a pre-hinging device. The pre-hinging device includes a lug boss 13 and a clamping groove 14. The lug boss 13 is at the hinged position of the upper pressing block 8*c*, and the clamping groove 14 is at a hinged position of the lower pressing block 8*d*. The upper pressing block 8*c* and the lower pressing block 8*d* are pre-hinged through the coordination of the lug boss 13 and the clamping groove 14, that is, the installation of the elastic sheet pressing block 8*a* can also be completed without the first pin shaft 21 installed. At the same time, through such a design, a coaxality of the upper pressing block 8*c* and the lower pressing block 8*d* can be further ensured, wear and tear can be reduced, and the overall installation is more simple and convenient.

Third Embodiment

Figure 2:
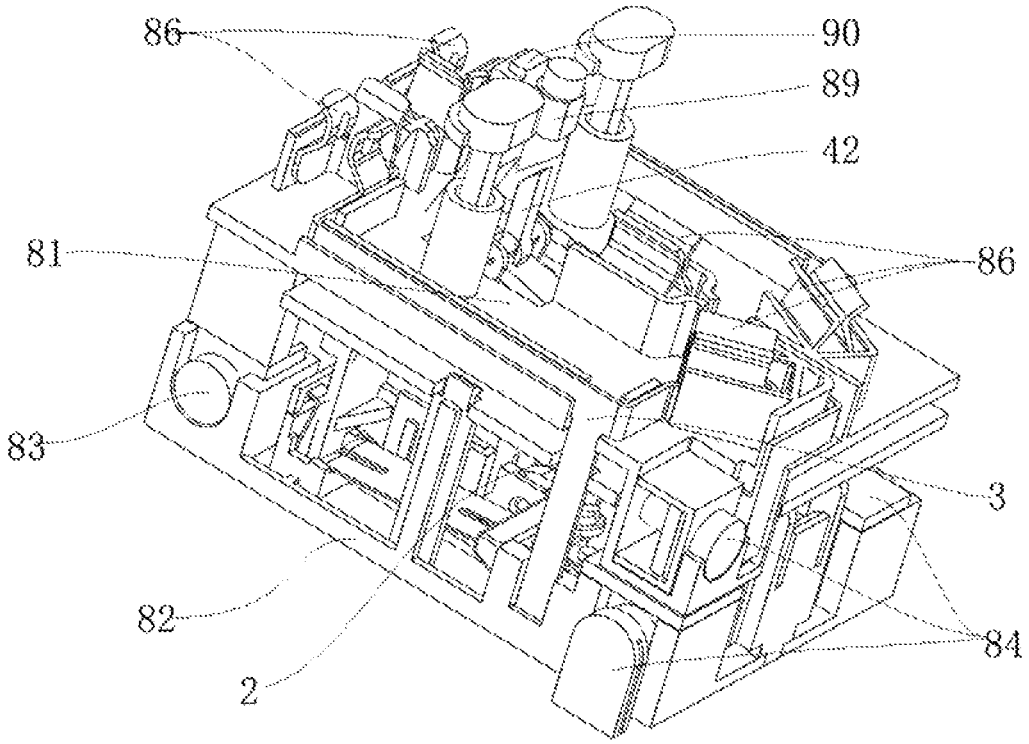
FIG. 2 is an internal structure diagram of a leakage protective socket in an on state according to the first embodiment of the disclosure.
Figure 3:
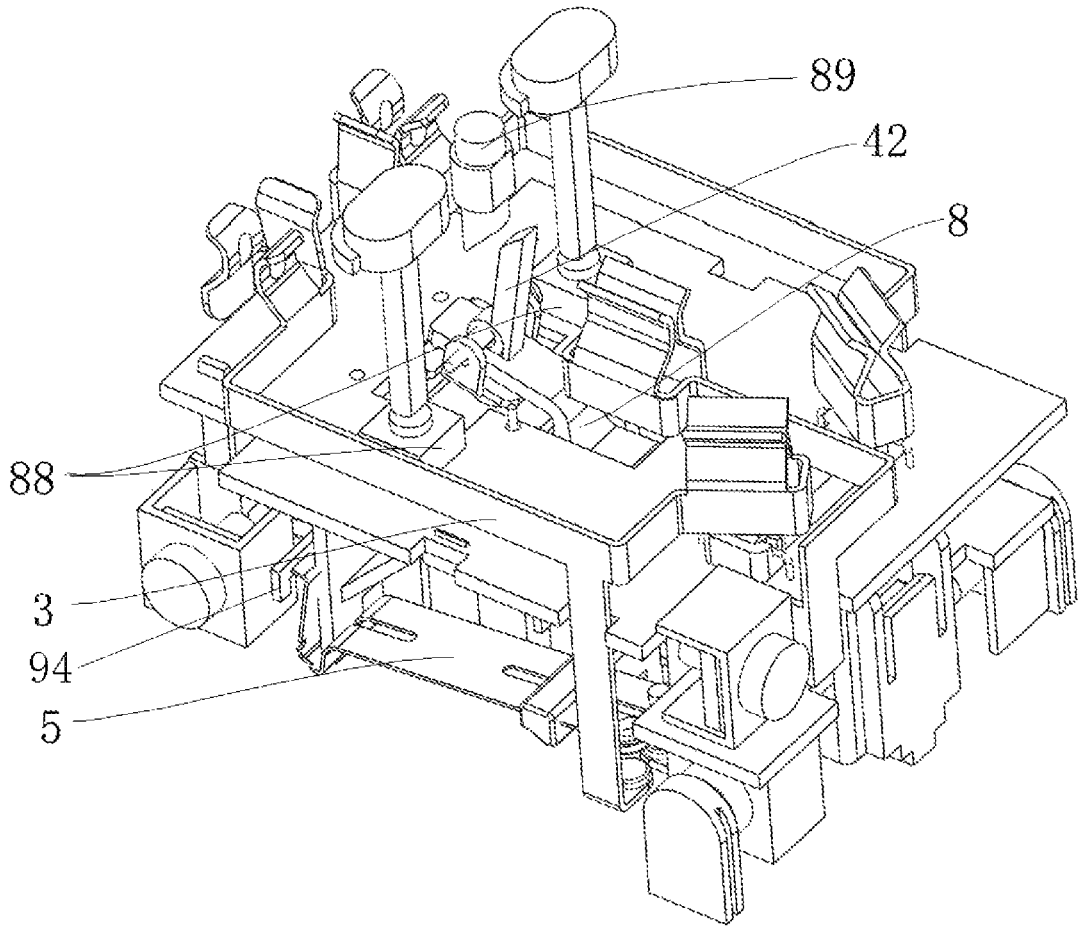
FIG. 3 is an internal structure diagram of a leakage protective socket in an off state according to the first embodiment of the disclosure.
Figure 4:
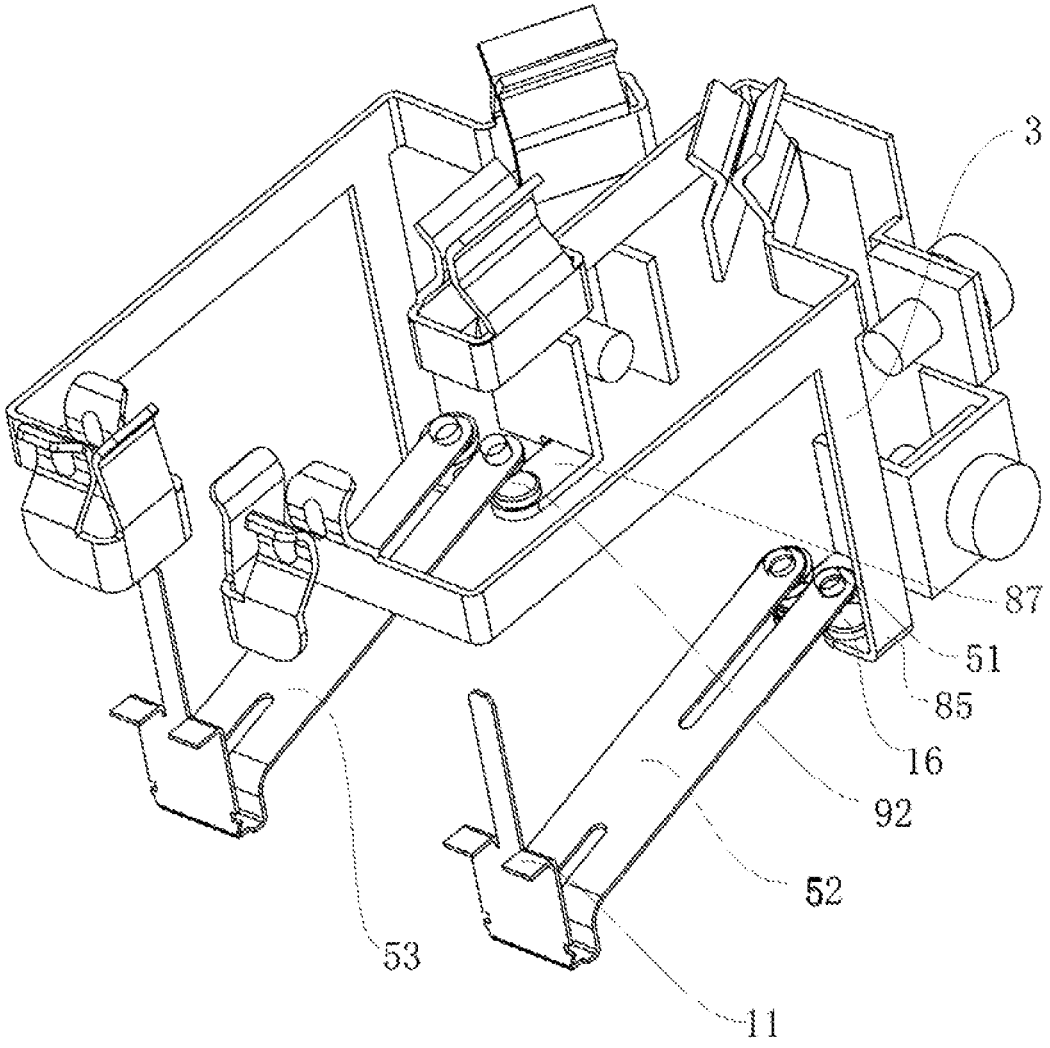
FIG. 4 is a structure diagram of an electrical connection portion and an elastic sheet of a leakage protective socket according to the first embodiment of the disclosure.
Figure 5:
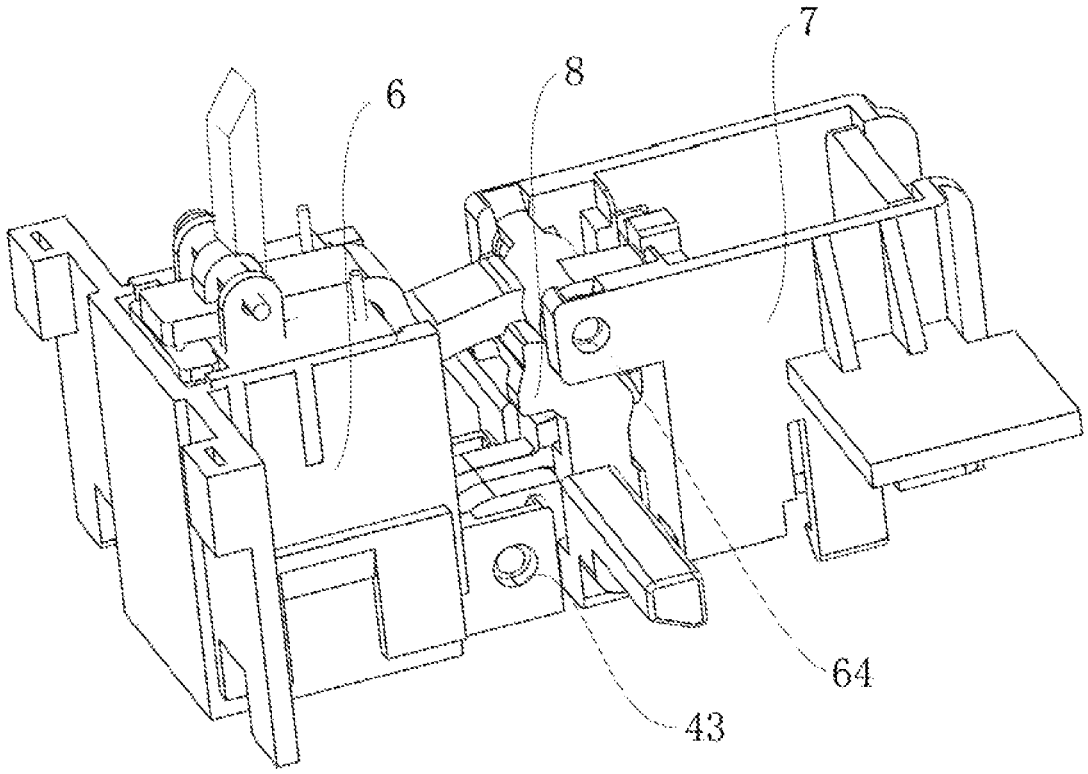
FIG. 5 is a structure diagram of a protector device of a leakage protective socket according to the first embodiment of the disclosure.

Compared with the first embodiment, in the present embodiment, the socket housing 1 also includes an extension wire base 84, and the extension wire base 84 is used for electrical connection with another receptacle or electric device. As shown in FIG. 2, the extension wire base 84 and the power socket 83 are respectively located at opposite sides of the leakage protective socket. The extension wire base 84 plays a role of output.

Besides, the extension wire base 84 is provided with an extension wiring end 87 which is extending, and the leakage protector is configured to control an opening and closing of a circuit between the power socket 83 and the extension wiring end 87. In the present embodiment, the extension wiring end 87 is provided with an extension wiring contact 92. The extension wiring contact 92 is disposed in parallel with the electrical contact 16. When the pressing rod 22 presses down the elastic sheet 5, the elastic sheet contact 51 is abutted against both the electrical contact 16 and the extension wiring contact 92. The electrical contact 16 and the extension wiring contact 92 are set as a whole and connected to the elastic sheet contact 51 to achieve the same effect.

Fourth Embodiment

Compared with the first embodiment, in the present embodiment, the socket housing 1 is provided with a second indication observing portion 90. The protector device 2 is provided with an indicator lamp. When the connection maintaining device 6 is powered on, it is observed through the second indication observing portion 90 that the indicator lamp lights up; that is, while the observation of indication is realized through the mechanical structure, the state of the indicator lamp is observed through the second indication observing portion 90, so as to judge a state of the protector device 2.

Fifth Embodiment

Compared with the first embodiment, in the present embodiment, the leakage protector also includes a mutual inductor. The mutual inductor includes a mutual inductor shell, a mutual inductance coil disposed inside the mutual inductor shell, and a hard electrical connecting wire 94 disposed on the mutual inductor shell in a penetration manner and passes through the mutual inductance coil. One end of the hard electrical connecting wire 94 is connected with the power socket 83, and the other end of the hard electrical connecting wire 94 is connected with an extending sheet 11 of the elastic sheet 5. In the present embodiment, the hard electrical connecting wire 94 is a metal sheet in a bending state. Generally, a soft power cord is directly threaded into the existing leakage protector, and in an assembly and installation process, this portion can only be installed manually, not automatically assembled. However, the structure of mutual inductor in the present embodiment can directly replace the soft power cord that needs to be manually threaded into the leakage protector by the hard metal sheet that is easy to plug, so it is suitable for automatic plugging assembly.

Sixth Embodiment

Figure 13:
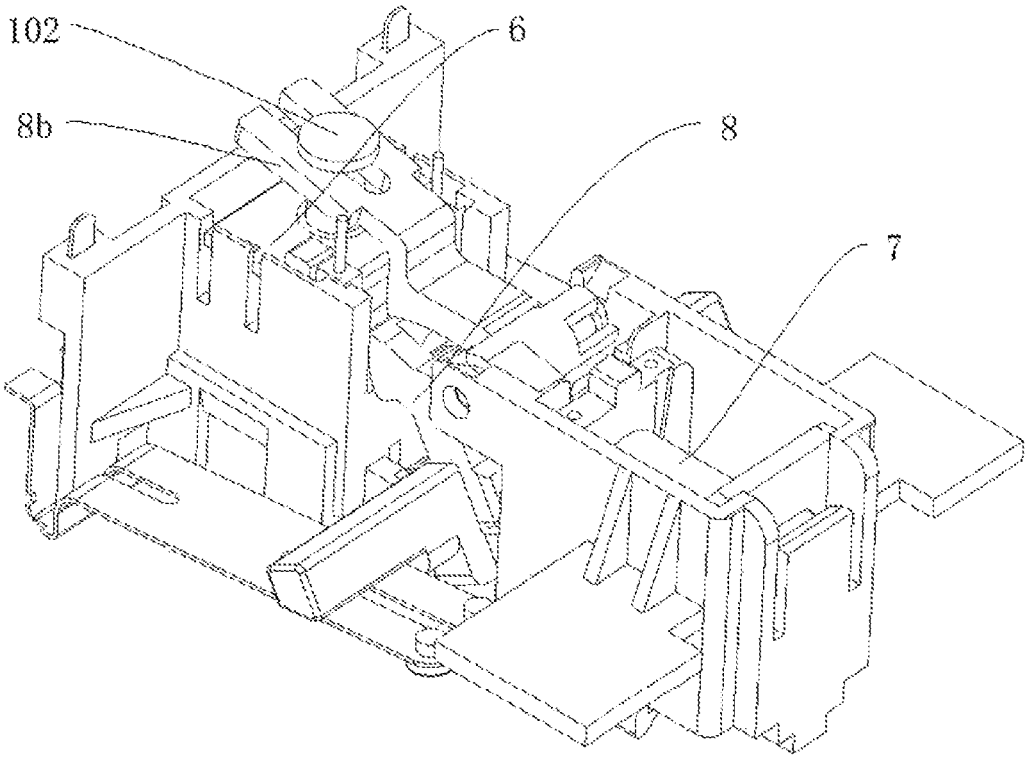
FIG. 13 is a structure diagram of a protector device in an off state according to the sixth embodiment of the disclosure.
Figure 14:
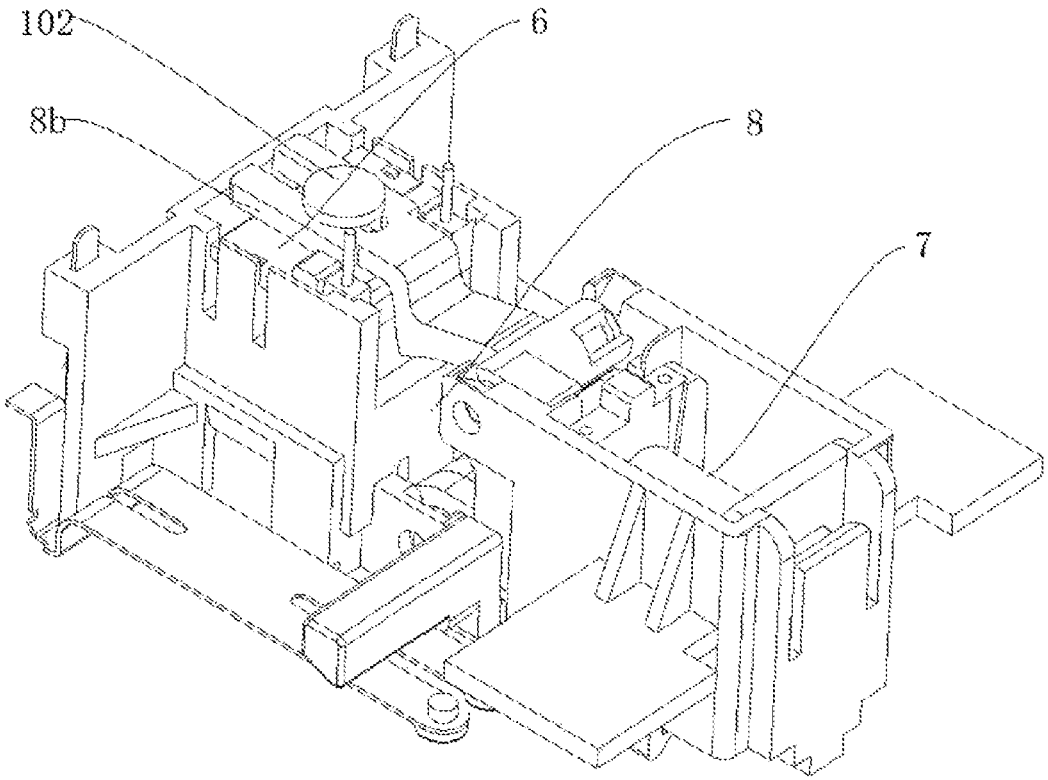
FIG. 14 is a structure diagram of a protector device in an on state according to the sixth embodiment of the disclosure.
Figure 15:
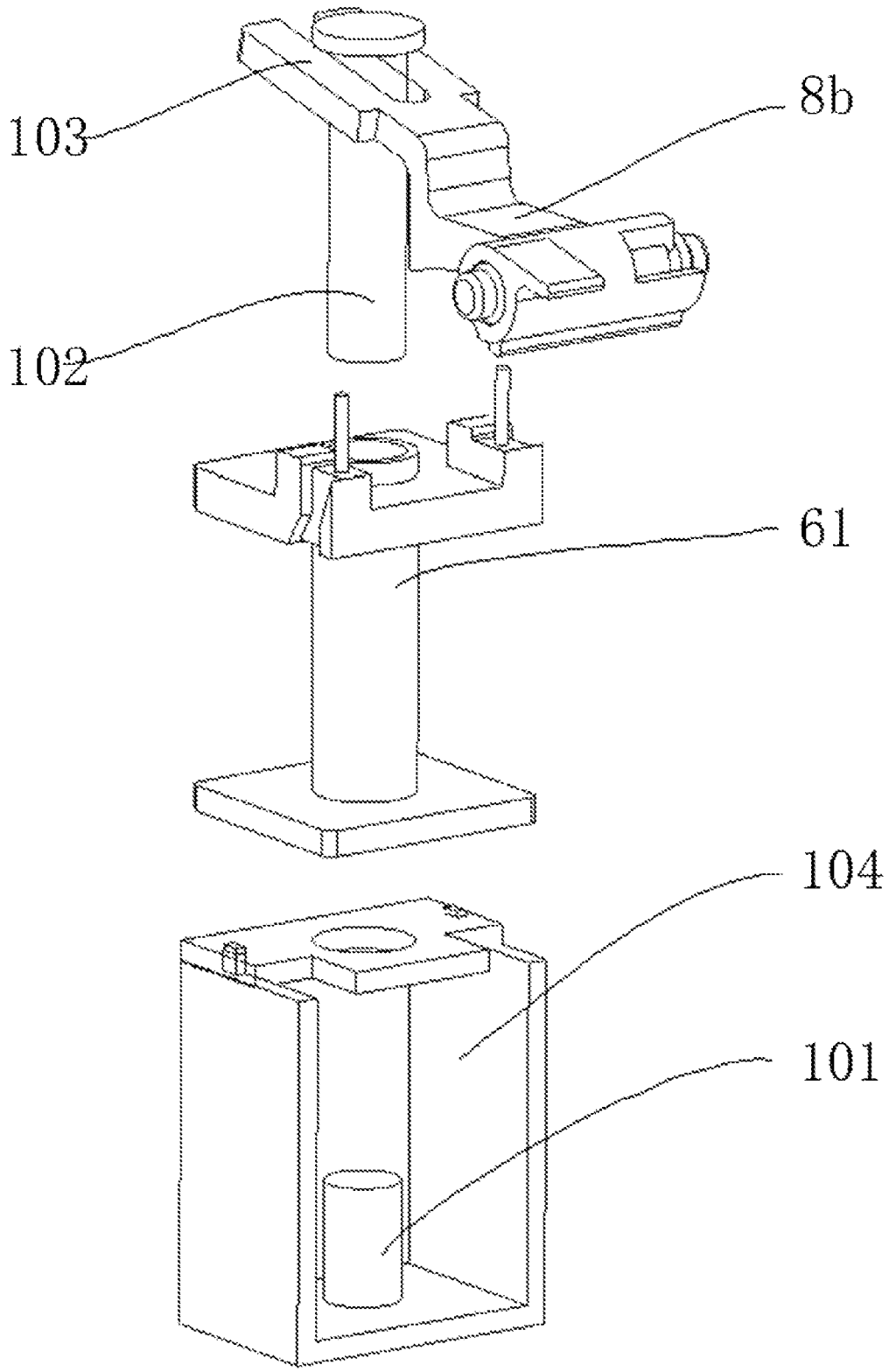
FIG. 15 is a structure diagram of a connection maintaining device according to the sixth embodiment of the disclosure.

Based on the first embodiment and the second embodiment, as shown in FIG. 13, FIG. 14 and FIG. 15, the structures of the connection maintaining device 6 and the locking device 8 are changed accordingly. In the present embodiments, the locking lever 8*b* is provided with a latch 33, a buckle slide 36 and a horizontal fork groove 103, and the connection maintaining device 6 includes a fixed iron core 101 vertically fixed in the connection maintaining device 6 and a movable iron core 102 extending longitudinally. The movable iron core 102 is in clamped coordination with the horizontal fork groove 103.

As shown in FIG. 13 and FIG. 14, there is a box-shaped fixing frame 104 for fixing the maintaining coil 61 provided in the cavity of the connection maintaining device 6. One end of the fixed iron core 101 is fixed with the bottom of the box-shaped fixing frame 104 and sleeved in the inner cavity of the maintaining coil 61. The movable iron core 102 is also sleeved in the inner cavity of the maintaining coil 61, and when another end of the fixed iron core 101 is abutted against the bottom of the movable iron core 102, another end of the movable iron core 102 is in clamped coordination with the horizontal fork groove 103. The box-shaped fixing frame 104 is made of metal. The box-shaped fixing frame 104 can form a closed magnetic loop, improve an adsorption effect between the fixed iron core 101 and the movable iron core 102, and reduce the requirement for the maintaining coil 61.

When the connection maintaining device 6 is powered on, an activity relationship of the leakage protector is as follows: the second iron core drives, through the vertical fork groove 23, the elastic sheet pressing block 8*a* to rotate, so that the pressing rod 22 located at the bottom of the elastic sheet pressing block 8*a* presses down the elastic sheet 5, at the same time, the buckle 24 slides upward along the buckle slide 36, and in the process that the buckle 24 slides to abut against the latch 33, the horizontal fork groove 103 drives the movable iron core 102 to continue moving downward, and the movable iron core 102 is absorbed and fixed through the fixed iron core 101, so that the connection maintaining device 6 fixes the position of the locking lever 8*b*, the elastic sheet pressing block 8*a* maintains the pressed-down state, and the elastic sheet 5 and the wiring end 85 maintain the on state, and then circuit closing is realized.

Compared with the structure design of absorbing to maintain through the movable pressing plate 34, which makes an obvious sound of absorption and collision, because the contact position between the fixed iron core 101 and the movable iron core 102 is inside the maintaining coil 61, the structure of absorbing to maintain in the present embodiment basically does not make a collision sound during the operation, thereby maintaining a certain mute effect.

The above is only the preferred embodiments of the disclosure; it should be indicated that, on the premise of not departing from the technical principles of the disclosure, those of ordinary skill in the art may also make a number of improvements and supplements, and these improvements and supplements should fall within the protective scope of the disclosure.

The invention claimed is:

1. A leakage protective socket, comprising: a socket housing, and a leakage protector and an electrical connection portion disposed in the socket housing;

wherein the socket housing comprises a support frame for fixing the electrical connection portion, a base for fixing the leakage protector, and a power socket for connecting an external power supply;

one end of the electrical connection portion is provided with a wiring end, and the other end of the electrical connection portion is provided with at least one plug-in end; an upper of the socket housing is provided with a receptacle hole corresponding to the plug-in end; the leakage protector is configured to control an opening and closing of a circuit between the power socket and the wiring end;

wherein the leakage protector comprises: a protector device and a elastic sheet; the protector device is disposed on an upper portion of the base, and controls an opening and closing of the elastic sheet and the wiring end;

the protector device comprises a connection maintaining device, a connecting device and a locking device; the locking device is disposed between the connection maintaining device and the connecting device;

the locking device comprises an elastic sheet pressing block, a locking lever, a first pin shaft and a second pin shaft; the locking lever is movably hinged with the second support, which is disposed on the connecting device, through the second pin shaft; the elastic sheet pressing block is movably hinged with a first support, which is disposed in a middle position of the base, through the first pin shaft; the locking lever is provided with a latch, a movable pressing plate and a buckle slide;

the elastic sheet pressing block is provided with a buckle, a vertical fork groove and a pressing rod; the buckle is used for abutting against the latch;

the connecting device is provided with a second iron core extending in a transverse direction which is in clamped coordination with the vertical fork groove; the connection maintaining device comprises a first iron core disposed longitudinally which is used for magnetic adsorption coordination with the movable pressing plate;

when the connection maintaining device is powered on, the second iron core drives, through the vertical fork groove, the elastic sheet pressing block to rotate, the pressing rod located at a bottom of the elastic sheet pressing block presses down the elastic sheet, at a same time, the buckle slides upward along the buckle slide, and in a process that the buckle slides to abut against the latch, the movable pressing plate continues moving downward and is fixed through absorption of the first iron core; the connection maintaining device is used for fixing a position of the locking lever, so that the elastic sheet pressing block maintains a pressed-down state, and the elastic sheet and the wiring end maintain an on state, and then circuit connecting is realized;

when the connection maintaining device is powered off, the connection maintaining device stops working, the locking lever is released, and the latch is out of the buckle, the elastic sheet is disconnected from the wiring end, and then circuit opening is realized: or wherein the leakage protector comprises: a protector device and a elastic sheet; the protector device is disposed on the upper the base, and controls an opening and closing of the elastic sheet and the wiring end;

the protector device comprises a connection maintaining device, a connecting device and a locking device; the locking device is disposed between the connection maintaining device and the connecting device;

the locking device comprises an elastic sheet pressing block, a locking lever, a first pin shaft and a second pin shaft; the locking lever is movably hinged with the second support, which is disposed on the connecting device, through the second pin shaft; the elastic sheet pressing block is movably hinged with a first support, which is disposed in a middle position of the base, through the first pin shaft; the locking lever is provided with a latch, a buckle slide and a horizontal fork groove;

the elastic sheet pressing block is provided with a buckle, a vertical fork groove and a pressing rod; the buckle is used for abutting against the latch;

the connecting device is provided with a second iron core extending in a transverse direction, which is in clamped coordination with the vertical fork groove;

the connection maintaining device also comprises a fixed iron core longitudinally fixed in the connection maintaining device and a movable iron core extending longitudinally; the movable iron core is in clamped coordination with the horizontal fork groove;

when the connection maintaining device is powered on, the second iron core drives, through the vertical fork groove, the elastic sheet pressing block to rotate, so that the pressing rod located at a bottom of the elastic sheet pressing block presses down the elastic sheet, at a same time, the buckle slides upward along the buckle slide, and in a process that the buckle slides to abut against the latch, the horizontal fork groove drives the movable iron core to continue moving downward, and the movable iron core is absorbed and fixed through the fixed iron core, so that the connection maintaining device fixes a position of the locking lever, the elastic sheet pressing block maintains a pressed-down state, and the elastic sheet and the wiring end maintain a on state, and then circuit connecting is realized;

when the connection maintaining device is powered off, the connection maintaining device stops working, the locking lever is released, and the latch is out of the buckle, so that the elastic sheet is disconnected from the wiring end, and then circuit opening is realized.

2. The leakage protective socket according to claim 1, wherein the socket housing is provided with a reset button and a test button, and bottoms of the reset button and the test button are respectively provided with a corresponding micro switch.

3. The leakage protective socket according to claim 1, wherein the socket housing is provided with a second indication observing portion, and the protector device is provided with an indicator lamp; when the connection maintaining device is powered on, it is observed through the second indication observing portion that the indicator lamp lights up.

4. The leakage protective socket according to claim 1, wherein the leakage protector comprises: the protector device and the elastic sheet; the protector device is disposed on an upper portion of the base, and controls an opening and closing of the elastic sheet and the wiring end;

the protector device comprises a connection maintaining device, a connecting device and a locking device; the locking device is disposed between the connection maintaining device and the connecting device;

the locking device comprises the elastic sheet pressing block, the locking lever, a first pin shaft and a second pin shaft; the locking lever is movably hinged with the second support, which is disposed on the connecting device, through the second pin shaft; the elastic sheet pressing block is movably hinged with a first support, which is disposed in a middle position of the base, through the first pin shaft; the locking lever is provided with a latch, a buckle slide and a horizontal fork groove;

the elastic sheet pressing block comprises an upper pressing block, a lower pressing block and a pressing block spring; the upper pressing block is provided with the buckle and the vertical fork groove; the lower pressing block is provided with the pressing rod; the upper pressing block is hinged with the lower pressing block through the first pin shaft; the pressing block spring in a compressed state is disposed between the upper pressing block and the lower pressing block; when the pressing rod is abutted against the elastic sheet, an elastic force of the pressing block spring makes the pressing rod maintain a stable force on the elastic sheet; the buckle is used for abutting against the latch;

the connecting device is provided with a second iron core extending in a transverse direction, which is in clamped coordination with the vertical fork groove;

the connection maintaining device also comprises a fixed iron core longitudinally fixed in the connection maintaining device and a movable iron core extending longitudinally; the movable iron core is in clamped coordination with the horizontal fork groove;

when the connection maintaining device is powered on, the second iron core drives, through the vertical fork groove, the elastic sheet pressing block to rotate, so that the pressing rod located at a bottom of the elastic sheet pressing block presses down the elastic sheet, at a same time, the buckle slides upward along the buckle slide, and in a process that the buckle slides to abut against the latch, the horizontal fork groove drives the movable iron core to continue moving downward, and the movable iron core is absorbed and fixed through the fixed iron core, so that the connection maintaining device fixes a position of the locking lever, the elastic sheet pressing block maintains a pressed-down state, and the elastic sheet and the wiring end maintain a on state, and then circuit connecting is realized;

when the connection maintaining device is powered off, the connection maintaining device stops working, the locking lever is released, and the latch is out of the buckle, so that the elastic sheet is disconnected from the wiring end, and then circuit opening is realized.

5. The leakage protective socket according to claim 1, wherein the locking lever is also provided with a pressing plate pin hole, and the movable pressing plate is hinged with the pressing plate pin hole through a pin shaft.

6. The leakage protective socket according to claim 1, wherein the elastic sheet comprises a first elastic sheet and a second elastic sheet; the first elastic sheet and the second elastic sheet are fixed through elastic sheet clamping slots disposed at two sides of the connection maintaining device;

the wiring end is provided with an electrical contact; ends of the first elastic sheet and the second elastic sheet are provided with an elastic sheet contact corresponding to the electrical contact; when the pressing rod presses down the elastic sheet, the elastic sheet contact is abutted against a corresponding electrical contact.

7. The leakage protective socket according to claim 1, wherein the leakage protector comprises: a protector device and an elastic sheet; wherein the protector device is disposed on an upper portion of the base, and used to control an opening and closing of the elastic sheet and the wiring end;

the protector device comprises a connection maintaining device, a connecting device and a locking device; the locking device is disposed between the connection maintaining device and the connecting device;

the locking device comprises an elastic sheet pressing block, a locking lever, a first pin shaft and a second pin shaft; the locking lever is movably hinged with a second support, which is disposed on the connecting device, through the second pin shaft; the elastic sheet pressing block is movably hinged with a first support, which is disposed in a middle position of the base, through the first pin shaft; the locking lever is provided with a latch, a movable pressing plate and a buckle slide;

the elastic sheet pressing block comprises an upper pressing block, a lower pressing block and a pressing block spring; the upper pressing block is provided with a buckle and a vertical fork groove; the lower pressing block is provided with a pressing rod; the upper pressing block is hinged with the lower pressing block through the first pin shaft; the pressing block spring in a compressed state is disposed between the upper pressing block and the lower pressing block; when the pressing rod is abutted against the elastic sheet, an elastic force of the pressing block spring makes the pressing rod maintain a stable force on the elastic sheet; the buckle is used for abutting against the latch;

the connecting device is provided with a second iron core extending in a transverse direction which is in clamped coordination with the vertical fork groove; the connection maintaining device comprises a first iron core disposed longitudinally, the a first iron core is used for magnetic adsorption coordination with the movable pressing plate;

when the connection maintaining device is powered on, the second iron core drives, through the vertical fork groove, the elastic sheet pressing block to rotate, the pressing rod located at a bottom of the elastic sheet pressing block is able to press down the elastic sheet, at a same time, the buckle slides upward along the buckle slide, and in a process that the buckle slides to abut against the latch, the movable pressing plate continues moving downward and is fixed through absorption of the first iron core; the connection maintaining device is used for fixing a position of the locking lever, so that the elastic sheet pressing block maintains a pressed-down state, and the elastic sheet and the wiring end maintain an on state, and then circuit connecting is realized;

when the connection maintaining device is powered off, the connection maintaining device stops working, the locking lever is released, and the latch is out of the buckle, the elastic sheet is disconnected from the wiring end, and then circuit opening is realized.

8. The leakage protective socket according to claim 7, wherein the leakage protective socket comprises:

a hinging base disposed on a hinging position between the upper pressing block and the lower pressing block; wherein the first pin shaft is disposed in the hinging base in a penetration manner; and a limiting block, disposed on the hinging base, wherein the limiting block is used for controlling an opening angle between the upper pressing block and the lower pressing block when rotating with the first pin shaft as an axis.

9. The leakage protective socket according to claim 7, wherein the connection maintaining device comprises a maintaining coil; the maintaining coil is fixed in a cavity of the connection maintaining device; the first iron core is vertically fixed in an inner cavity of the maintaining coil; one end of the first iron core is fixedly connected with a bottom of the connection maintaining device, and the other end of the first iron core is used for absorbing the movable pressing plate.

10. The leakage protective socket according to claim 7, wherein the connecting device also comprises a connecting coil and a connecting spring; the connecting coil is fixed in a cavity of the connecting device, and the connecting spring and the second iron core are horizontally disposed in an inner cavity of the connecting coil.

11. The leakage protective socket according to claim 7, wherein the elastic sheet comprises a first elastic sheet and a second elastic sheet; the first elastic sheet and the second elastic sheet are fixed through elastic sheet clamping slots disposed at two sides of the connection maintaining device;

the wiring end is provided with an electrical contact; ends of the first elastic sheet and the second elastic sheet are provided with an elastic sheet contact corresponding to the electrical contact; when the pressing rod presses down the elastic sheet, the elastic sheet contact is abutted against a corresponding electrical contact.

12. The leakage protective socket according to claim 11, wherein the socket housing comprises an extension wire base, which is used for electrical connection with another receptacle or electric device.

13. The leakage protective socket according to claim 12, wherein the extension wire base is provided with an extension wiring end which is extending, and the leakage protector is configured to control an opening and closing of a circuit between the power socket and the extension wiring end.

14. The leakage protective socket according to claim 13, wherein the extension wiring end is provided with an extension wiring contact; the extension wiring contact is disposed in parallel with the electrical contact; when the pressing rod presses down the elastic sheet, the elastic sheet contact is abutted against both the electrical contact and the extension wiring contact.

15. The leakage protective socket according to claim 7, wherein the locking lever is provided with a pressing plate pin hole, and the movable pressing plate is hinged with the pressing plate pin hole through a pin shaft.

16. The leakage protective socket according to claim 15, wherein the socket housing is provided with a first indication observing portion, the pressing plate pin hole is provided with an indication block, and a position of the first indication observing portion corresponds to a position of the indication block; when the connection maintaining device is powered on, the indication block is observed through the first indication observing portion.

17. The leakage protective socket according to claim 7, wherein the leakage protector comprises a mutual inductor; the mutual inductor comprises a mutual inductor shell, a mutual inductance coil disposed inside the mutual inductor shell, and a hard electrical connecting wire disposed on the mutual inductor shell in a penetration manner and passes through the mutual inductance coil; one end of the hard electrical connecting wire is connected with the power socket, and the other end of the hard electrical connecting wire is connected with the elastic sheet.

18. The leakage protective socket according to claim 17, wherein the hard electrical connecting wire is a metal sheet in a bending state.

* * * * *